US009797204B2

(12) United States Patent
Kirkhope

(10) Patent No.: US 9,797,204 B2
(45) Date of Patent: Oct. 24, 2017

(54) RELEASABLE LOCKING MECHANISM FOR LOCKING A HOUSING TO A DRILLING SHAFT OF A ROTARY DRILLING SYSTEM

(71) Applicant: HALLIBURTON ENERGY SERVICES, INC., Houston, TX (US)

(72) Inventor: Kennedy J. Kirkhope, Nisku (CA)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 15/503,972

(22) PCT Filed: Sep. 18, 2014

(86) PCT No.: PCT/US2014/056317
§ 371 (c)(1),
(2) Date: Feb. 14, 2017

(87) PCT Pub. No.: WO2016/043752
PCT Pub. Date: Mar. 24, 2016

(65) Prior Publication Data

US 2017/0234081 A1 Aug. 17, 2017

(51) Int. Cl.
*E21B 17/06* (2006.01)
*E21B 17/02* (2006.01)
(Continued)

(52) U.S. Cl.
CPC ..... *E21B 17/06* (2013.01); *E21B 7/062* (2013.01); *E21B 17/021* (2013.01); *E21B 17/1078* (2013.01)

(58) Field of Classification Search
CPC combination set(s) only.
See application file for complete search history.

(56) References Cited

U.S. PATENT DOCUMENTS 3,196,959 A 7/1965 Kammerer
3,824,437 A 7/1974 Blaschke
(Continued)

FOREIGN PATENT DOCUMENTS

GB 2172325 A 9/1986
GB 2230288 A 10/1990
(Continued)

OTHER PUBLICATIONS

Sugiura, Junichi, "Downhole Steering Automation and New Survey Measurement Method Significantly Improves High-Dogleg Rotary-Steerable System Performance", SPE-166165, 2013, Society of Petroleum Engineers, pp. 1-10.
(Continued)

*Primary Examiner* — Cathleen R Hutchins
*Assistant Examiner* — Ronald R Runyan
(74) *Attorney, Agent, or Firm* — Polsinelli PC

(57) ABSTRACT

Downhole rotary steerable drill including a drilling shaft rotatably supported within a housing, the drilling shaft and housing each having a longitudinal axis. The drill can include a releasable locking mechanism for rotationally locking and releasing the drilling shaft relative to the housing, the releasable locking mechanism transitionable between locked and released configurations. The releasable locking mechanism includes a sliding plunger coupled to the housing by a coupling that permits longitudinal reciprocation of the sliding plunger relative to the housing and prevents rotation of the sliding plunger relative to the housing. The releasable locking mechanism can also include pressure-responsive piston that reciprocates between an unactuated configuration and actuated configuration in response to applied pressure from a pressuring pump.

19 Claims, 10 Drawing Sheets

(51) Int. Cl.
*E21B 7/06* (2006.01)
*E21B 17/10* (2006.01)

(56) References Cited

U.S. PATENT DOCUMENTS

| | | | | |
|---|---|---|---|---|
| 4,299,296 | A | 11/1981 | Geczy | |
| 4,324,297 | A | 4/1982 | Denison | |
| 4,394,881 | A | 7/1983 | Shirley | |
| 4,407,377 | A | 10/1983 | Russell | |
| 4,445,578 | A | 5/1984 | Millheim | |
| 4,476,943 | A | 10/1984 | Williams | |
| 4,491,187 | A | 1/1985 | Russell | |
| 4,662,458 | A | 5/1987 | Ho | |
| 4,739,841 | A | 4/1988 | Das | |
| 4,754,821 | A | 7/1988 | Swietlik | |
| 4,821,563 | A | 4/1989 | Maron | |
| 4,947,944 | A | 8/1990 | Coltman et al. | |
| 4,958,517 | A | 9/1990 | Maron | |
| 5,168,941 | A | 12/1992 | Krueger et al. | |
| 5,220,963 | A | 6/1993 | Patton | |
| 5,265,684 | A | 11/1993 | Rosenhauch | |
| 5,293,945 | A | 3/1994 | Rosenhauch et al. | |
| 5,368,110 | A | 11/1994 | French | |
| 5,386,724 | A | 2/1995 | Das et al. | |
| 5,421,421 | A | 6/1995 | Appleton | |
| 5,467,834 | A | 11/1995 | Hughes et al. | |
| 5,547,031 | A | 8/1996 | Warren et al. | |
| 5,608,162 | A | 3/1997 | Ho | |
| 5,685,379 | A | 11/1997 | Barr et al. | |
| 5,720,355 | A | 2/1998 | Lamine et al. | |
| 5,931,239 | A | 8/1999 | Schuh | |
| 6,068,394 | A | 5/2000 | Dublin | |
| 6,082,457 | A | 7/2000 | Best et al. | |
| 6,092,610 | A | 7/2000 | Kosmala et al. | |
| 6,158,529 | A | 12/2000 | Dorel | |
| 6,227,313 | B1 | 5/2001 | Davis et al. | |
| 6,233,524 | B1 | 5/2001 | Harrell et al. | |
| 6,244,361 | B1 | 6/2001 | Comeau et al. | |
| 6,321,857 | B1 | 11/2001 | Eddison | |
| 6,328,119 | B1 | 12/2001 | Gills et al. | |
| 6,415,878 | B1 | 6/2002 | Cargill et al. | |
| 6,439,321 | B1 * | 8/2002 | Gillis | E21B 7/068 166/117.5 |
| 6,550,548 | B2 | 4/2003 | Taylor | |
| 6,769,499 | B2 | 8/2004 | Cargill et al. | |
| 6,840,336 | B2 | 1/2005 | Schaag et al. | |
| 7,036,580 | B2 | 5/2006 | McGarian et al. | |
| 7,147,066 | B2 | 12/2006 | Chen et al. | |
| 7,178,611 | B2 * | 2/2007 | Zupanick | E21B 17/04 175/107 |
| 7,216,726 | B2 | 5/2007 | Swietlik et al. | |
| 7,306,058 | B2 | 12/2007 | Cargill et al. | |
| 7,306,060 | B2 | 12/2007 | Krueger et al. | |
| 7,413,032 | B2 | 8/2008 | Krueger | |
| 7,413,034 | B2 | 8/2008 | Kirkhope et al. | |
| 7,426,967 | B2 | 9/2008 | Sugiura | |
| 7,445,060 | B2 | 11/2008 | Stroud et al. | |
| 7,464,770 | B2 | 12/2008 | Jones et al. | |
| 7,467,673 | B2 | 12/2008 | Earles et al. | |
| 7,481,282 | B2 | 1/2009 | Horst et al. | |
| 7,588,082 | B2 | 9/2009 | Lasater | |
| 7,637,321 | B2 | 12/2009 | Zazovsky et al. | |
| 7,685,732 | B2 | 3/2010 | Davis et al. | |
| 7,703,550 | B2 | 4/2010 | Nevlud et al. | |
| 7,735,581 | B2 | 6/2010 | Beylotte et al. | |
| 7,762,356 | B2 | 7/2010 | Turner et al. | |
| 7,775,099 | B2 | 8/2010 | Bogath et al. | |
| 7,798,253 | B2 | 9/2010 | Schuh | |
| 7,950,473 | B2 | 5/2011 | Sugiura | |
| 7,967,081 | B2 | 6/2011 | Sugiura | |
| 8,118,114 | B2 | 2/2012 | Sugiura | |
| 8,191,651 | B2 | 6/2012 | Hall et al. | |
| 8,286,733 | B2 | 10/2012 | Tulloch et al. | |
| 8,302,703 | B2 | 11/2012 | Rolovic | |
| 8,360,172 | B2 | 1/2013 | Santelmann | |
| 8,453,765 | B2 | 6/2013 | Haughom | |
| 8,484,858 | B2 | 7/2013 | Brannigan et al. | |
| 8,534,380 | B2 | 9/2013 | Sheppard et al. | |
| 8,833,491 | B2 * | 9/2014 | Sonar | E21B 4/006 166/240 |
| 2002/0070032 | A1 | 6/2002 | Maguire et al. | |
| 2004/0144567 | A1 | 7/2004 | Boyd | |
| 2008/0264692 | A1 | 10/2008 | Underwood et al. | |
| 2011/0240368 | A1 | 10/2011 | Allen et al. | |
| 2012/0046865 | A1 | 2/2012 | Heisig et al. | |
| 2012/0055327 | A1 | 3/2012 | Holowczak | |
| 2012/0061099 | A1 | 3/2012 | Wold et al. | |
| 2012/0285746 | A1 | 11/2012 | Kvalvik | |
| 2013/0146363 | A1 | 6/2013 | Haughom | |
| 2014/0231144 | A1 | 8/2014 | Sonar et al. | |

FOREIGN PATENT DOCUMENTS

| | | | |
|---|---|---|---|
| GB | 2425791 | A | 11/2006 |
| WO | 9008245 | A1 | 7/1990 |
| WO | 12162833 | A1 | 12/2012 |

OTHER PUBLICATIONS

Kapoh, Oddy, "New Locking Clutch Turbine Technology Successfully Frees Stuck Bit/BHA in Deep Gas Wells Oman", SPE-144903, 2011, Society of Petroleum Engineers, pp. 1-12.

Warren, Tommy; "Slimhole rotary steerable system broadens applications"; World Oil, Sep. 1997. 6 Pgs.

Weatherford; Revolutionizing drilling efficiency in all types of environments, 2009, 16 Pgs.

Rotary Steerable System; (http://www.bakerhughes.com/products-and-services/drilling/drill-bit-systems) published on Jan. 11, 2010, 4 Pgs.

Oil and Gas Journal , "Rotary Steerable System Replaces Slide Mode for Directional Drilling Applications", http://www.ogj.com/articles/print/volume-96/issue-9/in-this-issue/general-interest/rotary-steerable-system-replaces-slide-mode-for-directional-drilling-applications.html; published on Mar. 2, 1998, 6 Pgs.

Clegg, Barr; Steerable Rotary Drilling with an Experimental System, https://www.onepetro.org/, SPE/IADC 29382, 1995, SPE/IADC Drilling Conference, pp. 435-450.

Barton, "Coupling of Downhole Dynamics Recorder Enhance System-Matched Approach to Drill Bit Design and Application with a Specific Rotary Steerable System." SPE-102182; 2006, Society of Petroleum Engineers, pp. 1-14.

Wolter, "The First OffShore Use of an Ultra High Speed Drilling Telemetry Network Involving a Full LWD Logging Suite and Rotary Steerable Drilling System", SPE-110939, 2007, Society of Petroleum Engineers, pp. 1-8.

Sugiura, "Integrated Approach to Rotary-Steerable Drilling Optimization using Concurrent Real-Time measurement of Near-bit Borehole Caliper and Near-bit Vibration.", SPE-112163, 2008, Society of Petroleum Engineers, pp. 1-19.

Schlumberger; PowerDrive vorteX Powered Rotary Steerable System; http://www.slb.com/services/drilling/directional_drilling/powerdrive_family/powerdrive_vortex.aspx; 2013 Schlumberger Limited and retrieved Nov. 7, 2013, 2 Pgs.

Hood; "Real-Time BHA Bending Information Reduces Risk when Drilling Hard Interbedded BHA Bending Information Reduces Risk when Drilling Hard Interbedded Formations." SPE/IADC 79918, 2003 SPE/IADC Drilling Conference, pp. 1-12.

Sugiura, "The Use of the Industry's First 3-D Mechanical Caliper Image While Drilling Leads to Optimized Rotary-Steerable Assemblies in Push- and Point-the-Bit Configurations", SPE-115395, 2008, Society of Petroleum Engineers, pp. 1-12.

International Search Report and Written Opinion; PCT Application No. PCT/US2014/056317; dated May 29, 2015.

* cited by examiner

RELEASABLE LOCKING MECHANISM FOR LOCKING A HOUSING TO A DRILLING SHAFT OF A ROTARY DRILLING SYSTEM

CROSS-REFERENCE TO RELATED APPLICATIONS

This application is a national stage entry of PCT/US2014/056317 filed Sep. 18, 2014, said application is expressly incorporated herein in its entirety.

FIELD

The present disclosure relates generally to drilling systems, and particularly to a drilling system for oil and gas exploration and production operations.

BACKGROUND

In oil and gas exploration, directional drilling techniques are sometimes used to control the direction of the drill bit. A rotary steerable drilling system is one type of directional drilling system that allows a drill string to rotate continuously while steering the drill bit to a desired target location in a subterranean formation. Rotary steerable drilling systems are generally positioned at a lower end of the drill string and typically include a rotating drill shaft or mandrel, a housing that rotatably supports the drill shaft, and additional components within the housing that orient the toolface direction of the drill bit at the end of the drill shaft relative the housing. In a normal operating condition, the rotating drill shaft rotates relative to the housing, but there are situations in which it is advantageous to lock the drill shaft to the housing.

BRIEF DESCRIPTION OF THE DRAWINGS

Implementations of the present technology will now be described, by way of example only, with reference to the attached figures, wherein.

DETAILED DESCRIPTION

Figure 1:
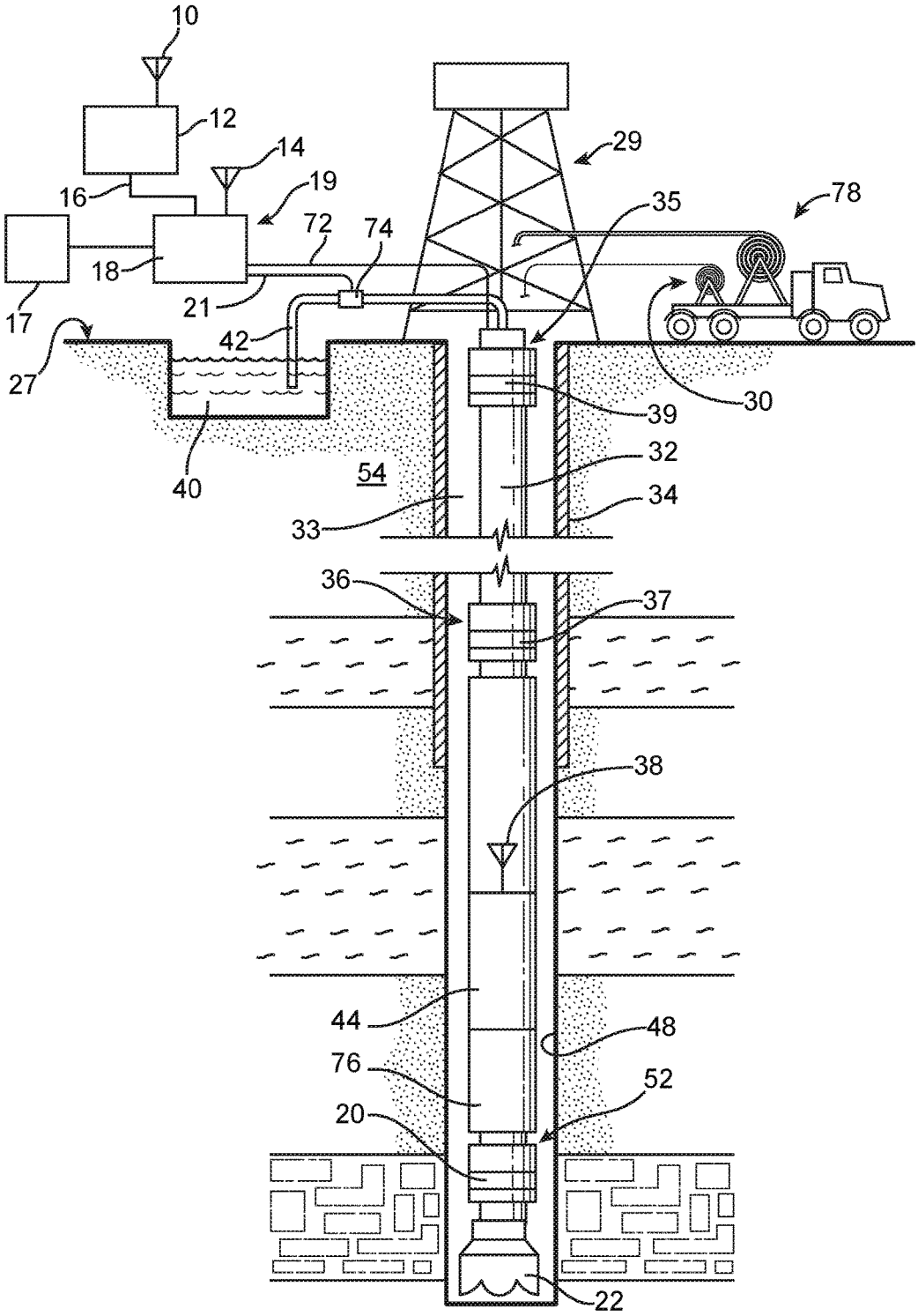
FIG. 1 is a partial cross-section view illustrating an embodiment of a drilling rig for drilling a wellbore with the drilling system configured in accordance with the principles of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the following description, terms such as "upper," "upward," "lower," "downward," "above," "below," "downhole," "uphole," "longitudinal," "lateral," and the like, as used herein, shall mean in relation to the bottom or furthest extent of, the surrounding wellbore even though the wellbore or portions of it may be deviated or horizontal. Correspondingly, the transverse, axial, lateral, longitudinal, radial, and the like orientations shall mean positions relative to the orientation of the wellbore or tool. Additionally, the illustrated embodiments are depicted so that the orientation is such that the right-hand side is downhole compared to the left-hand side.

Several definitions that apply throughout this disclosure will now be presented. The term "coupled" is defined as connected, whether directly or indirectly through intervening components, and is not necessarily limited to physical connections. The connection can be such that the objects are permanently connected or releasably connected. The term "communicatively coupled" is defined as connected, either directly or indirectly through intervening components, and the connections are not necessarily limited to physical connections, but are connections that accommodate the transfer of data between the so-described components. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other thing that "substantially" modifies, such that the component need not be exact. For example, substantially cylindrical means that the object resembles a cylinder, but can have one or more deviations from a true cylinder. The terms "comprising," "including" and "having" are used interchangeably in this disclosure. The terms "comprising," "including" and "having" mean to include, but not necessarily be limited to the things so described.

The term "radial" and/or "radially" means substantially in a direction along a radius of the object, or having a directional component in a direction along a radius of the object, even if the object is not exactly circular or cylindrical. The term "axially" means substantially along a direction of the axis of the object. If not specified, the term axially refers to the long or longitudinal axis of the object.

Disclosed herein is a releasable locking mechanism, also described as a one-way clutch, for rotationally locking and releasing a drilling shaft relative to a housing. The releasable locking mechanism is transitionable between locked and released configurations. In at least one example, the drilling shaft and the housing can be a part of a downhole rotary drilling system, including for example a rotary steerable drill. The drilling shaft is rotatably supported within the housing. In at least one example, the drilling shaft and the housing each have a common longitudinal axis. The locking mechanism as presented herein provides a locking arrangement that can be engaged by rotating the drilling shaft in a rotational direction opposite to the rotational drilling direction. Additionally, the locking mechanism allows for synchronized rotation of the drilling shaft and the housing once engaged.

The releasable locking mechanism can comprise a sliding plunger, a ratchet mechanism, a pressure-responsive piston and a pressuring pump. The sliding plunger can be coupled to the housing by a coupling that permits longitudinal reciprocation of the sliding plunger relative to the housing and prevents rotation of the sliding plunger relative to the housing. The sliding plunger is engageable with a ratchet mechanism that prevents rotation of the drilling shaft relative to the housing in a drilling rotational direction. The ratchet mechanism permits rotation of the drilling shaft relative to the housing in a direction opposite to the drilling rotational direction in the locked configuration of the locking mechanism.

The pressure-responsive piston is configured to reciprocate within the housing. The pressure-responsive piston reciprocates between an unactuated configuration and actuated configuration in response to applied pressure from a pressuring pump. The actuated configuration of the pressure-responsive piston corresponds to the locked configuration of the locking mechanism. In the locked configuration, the plunger engages with the ratchet mechanism.

The pressure-responsive piston can further comprise a pressure equalization valve configured to provide pressure relief and return the pressure responsive piston to the unactuated configuration. The pressure-responsive piston can further comprise a flow restrictor configured to restrict flow of fluid entering the pressure-responsive piston from an end nearest to the sliding plunger.

The releasable locking mechanism can further comprise an engagement biasing member located between the sliding plunger and the pressure-responsive piston, wherein the engagement biasing member provides an engagement force and allows the sliding plunger to disengage the ratchet mechanism when the drilling shaft is rotated in the direction opposite to the drilling rotational direction. In at least one example, the engagement biasing member can be a spring member. The releasable locking mechanism can further comprise a disengagement biasing member configured to urge the sliding plunger to a released configuration.

The pressuring pump is configured to drive flow in an actuating direction and releasing direction that is opposite to the actuating direction. The pressuring pump can be coupled to the drilling shaft and provides pressure to the pressure-responsive piston when the drilling shaft is rotated in the direction opposite to the drilling rotational direction.

The ratchet mechanism comprises two substantially sawtooth profiles that are configured to lock together in the rotational drilling direction and slip relative to one another in the rotational direction opposite to the rotational drilling direction. One of the two substantially sawtooth profiles is located on the sliding plunger and the other of the two substantially sawtooth profiles is located on a drilling shaft engagement member that is rotationally fixed to the drilling shaft. In the instance of the one-way clutch, two mutually engageable ratchet surfaces are utilized, that when engaged, retard relative motion when the drilling shaft rotates in the drilling direction.

The downhole rotary steerable drill further comprises an anti-rotation device configured to substantially limit rotation of the housing relative to the formation in which the downhole rotary steerable drill is deployed. The anti-rotation device is fluidly coupled to the pressuring pump. The anti-rotation device can be configured to be retracted when the pressuring pump provides pressure to the pressure-responsive piston. The antirotation device is configured to be in a retracted configuration when the releasable locking mechanism is in a locked configuration. Additionally, the anti-rotation device can be spring biased in an outward direction.

The releasable locking mechanism further comprises the drilling shaft engagement member which is coupled to the drilling shaft. The drilling shaft engagement member is configured to move in an axial direction relative to the drilling shaft and can remain in a fixed rotational position relative to the drilling shaft. The ratchet mechanism can be partially located on the sliding plunger and partially located on the drilling shaft engagement member.

The releasable locking mechanism further comprises a piston stop formed on the inside of the housing. The piston stop prevents axial movement of the pressure-responsive piston beyond a predetermined position in the actuated configuration. The piston stop can be a beveled shoulder. The pressure-responsive piston can have a mating portion that is configured to abuttingly engage the beveled shoulder.

Alternatively, the disclosed drilling system can be described as comprising a drilling shaft rotatably supported in a housing and the drilling shaft rotates in a drilling direction relative the housing during active drilling. A one-way clutch that is reverse-rotation actuated is coupled between the housing and the drilling shaft. The clutch secures the drilling shaft to the housing as a result of rotation of the drilling shaft in the direction opposite to the drilling direction. The one-way clutch comprises two mutually engageable ratchet surfaces, that when engaged, retard relative motion when the drilling shaft rotates in the drilling direction. Alternatively, the one-way clutch facilitates relative motion between the drilling shaft and housing when the drilling shaft is rotated in the direction opposite to the drilling direction. A splined coupling that permits translational motion and prevents rotational motion interconnects one of the two ratchet surfaces to one of the drilling shaft and the housing. A pressure activated actuator moves the spline-coupled ratchet surface toward and into engagement with the other ratchet surface when the drilling shaft is rotated in the direction opposite to the drilling direction. In this way, the one-way clutch is transitioned from a released configuration to a locked configuration in which rotation of the drilling shaft in the drilling direction rotates the housing in the drilling direction.

The pressure activated actuator further comprises a sliding plunger on which the spline-coupled ratchet surface is located and the sliding plunger is keyed to the housing by the splined coupling. A pump is included that is in fluid communication with a piston that reciprocates between an unactuated configuration and an actuated configuration in response to delivered pressure from the pump. The actuated configuration of the piston corresponds to the locked configuration of the one-way clutch. In the actuated configuration, the piston is engaged with the sliding plunger and the ratchet surfaces abut one another.

The present description also discloses a method for locking a housing of a downhole rotary steerable drill to a drilling shaft supported within the housing. The method comprises applying pressure to a pressure-responsive piston. Also, the method comprises translating a sliding plunger coupled to the pressure-responsive piston. Further still, the method comprises releasably locking the sliding plunger to the drilling shaft by a ratchet mechanism that prevents rotation of the drilling shaft relative to the housing in a drilling rotational direction and permits rotation of the drilling shaft relative to the housing in a direction opposite to the drilling rotational direction in the locked configuration of the locking mechanism.

Alternatively, the method can be described as a method of locking a housing of a drilling system to a rotary drilling shaft supported within the housing. The method comprises reverse-rotating, in the direction opposite to the drilling rotational direction, a one-way clutch coupled between the housing and the drilling shaft and thereby securing the drilling shaft to the housing against relative rotation therebetween. Two mutually engageable ratchet surfaces, that when engaged together, retard relative motion therebetween when the drilling shaft rotates in the drilling direction, but facilitates relative motion therebetween when the drilling shaft is oppositely rotated to the drilling direction. The method further comprises utilizing a pressure activated actuator to move one ratchet surface toward and into engagement with the other ratchet surface when the drilling shaft is rotated in the direction opposite to the drilling direction, and in this way the one-way clutch is transitioned from a released configuration to a locked configuration in which rotation of the drilling shaft in the drilling direction rotates the housing in the drilling direction. The present disclosure describes one embodiment in relation to a subterranean well that is depicted schematically in FIG. 1. In other embodiments, the subterranean well may include some, none, or all of the features shown in FIG. 1 without departing from the scope of the present disclosure. A wellbore 48 is shown that has been drilled into the earth 54 from the ground's surface 27 using a drill bit 22. The drill bit 22 is located at the bottom, distal end of the drill string 32 and the bit 22 and drill string 32 are being advanced into the earth 54 by the drilling rig 29. The drilling rig 29 can be supported directly on land as shown or on an intermediate platform if at sea. For illustrative purposes, the top portion of the well bore includes casing 34 that is typically at least partially comprised of cement and which defines and stabilizes the wellbore after being drilled.

As shown in FIG. 1, the drill string 32 supports several components along its length. A sensor sub-unit 52 is shown for detecting conditions near the drill bit 22, conditions which can include such properties as formation fluid density, temperature and pressure, and azimuthal orientation of the drill bit 22 or string 32. In the case of directional drilling, measurement while drilling (MWD)/logging while drilling (LWD) procedures are supported both structurally and communicatively. FIG. 1 shows an instance of directional drilling. The lower end portion of the drill string 32 can include a drill collar proximate the drilling bit 22 and a rotary steerable drilling device 20. The drill bit 22 may take the form of a roller cone bit or fixed cutter bit or any other type of bit known in the art. The sensor sub-unit 52 is located in or proximate to the rotary steerable drilling device 20 and may include sensors which detect the azimuthal orientation of the rotary steerable drilling device 20. Other sensor sub-units 35, 36 are shown within the cased portion of the well which can be enabled to sense nearby characteristics and conditions of the drill string, formation fluid, casing and surrounding formation. Regardless of which conditions or characteristics are sensed, data indicative of those conditions and characteristics is either recorded downhole, for instance at the processor 44, for later download, or communicated to the surface either by wire using repeaters 37,39 up to surface wire 72, or wirelessly, or otherwise. In some wireless embodiments, the downhole transceiver (antenna) 38 may be utilized to send data to a local processor 18 via topside transceiver (antenna) 14. There the data may be either processed or further transmitted along to a remote processor 12 via wire 16 or wirelessly via antennae 14 and 10.

FIG. 1 further shows implementations including coiled tubing 78 and wireline 30 procedures within the context of this disclosure.

In some embodiments, drilling mud 40 that is pumped via conduit 42 to a downhole mud motor 76 may provide an additional or alternative mode of communication. The drilling mud 40 is circulated down through the drill string 32 and up the annulus 33 around the drill string 32 to cool the drill bit 22 and remove cuttings from the wellbore 48. For purposes of communication, resistance to the incoming flow of mud can be modulated downhole to send backpressure pulses up to the surface for detection at sensor 74, or to a pressure sensor disposed along drill string 32, and from which representative data is sent along communication channel 21 (wired or wirelessly) to one or more processors 18, 12 for recordation and/or processing. In further examples, the drilling mud is circulated to mud motor 76 which is employed to rotate the drill bit 22. The mud motor 76 may include a rotor and stator contained within the housing. The flow of mud causes rotation of the rotor within the stator, and in turn, rotates the drill bit 22.

The sensor sub-unit 52 is located along the drill string 32 above the drill bit 22. Additional sensor sub-units 36, 35 are shown in FIG. 1 positioned above the mud motor 76 that rotates the drill bit 22. Additional sensor sub-units 35, 36 can be included as desired in the drill string 32. The sub-unit 52 positioned below the motor 76 may communicate with the sub-units 36, 35 in order to relay information to the surface 27.

A surface installation 19 is shown that sends and receives data to and from the well. The surface installation 19 may include a local processor 18 in communication with one or more remote processors 12, 17 by wire 16 or wirelessly using transceivers 10, 14.

In one example, a mud motor 76 rotates the drill bit 22 as described above. Another example of a rotary drilling system includes a rotary steerable drilling device. Such a rotary steerable drilling device 20 is diagrammatically shown in FIG. 1 and described with particularity in association with FIG. 2 below. This arrangement can also be referred to as a drilling direction control device or system. As shown, the rotary drilling device 20 is positioned on the drill string 32 with drill bit 22. However, one of skill in the art will recognize that the positioning of the rotary steerable drilling device 20 on the drill string 22 and relative to other components on the drill string 22 may be modified while remaining within the scope of the present disclosure.

Figure 2:
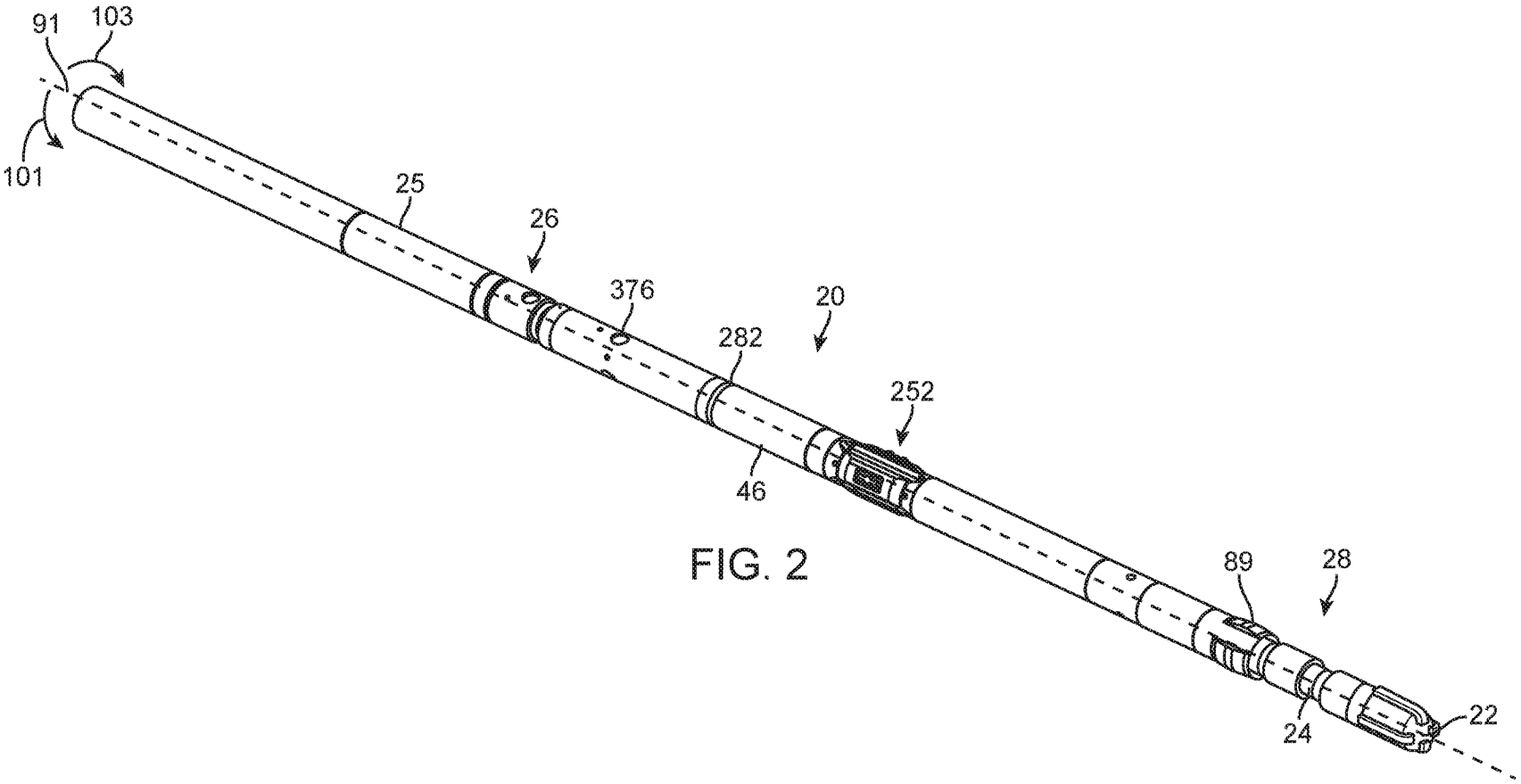
FIG. 2 is a perspective view of one embodiment of a rotary steerable drilling device according to the present disclosure.

Referring now to FIG. 2, the rotary steerable drilling device 20 is comprised of a rotatable drilling shaft 24 that is connectable or attachable to a rotary drill bit 22 and to a rotary drilling string 25 during the drilling operation. More particularly, the drilling shaft 24 has a proximal end 26 closest to the earth's surface and a distal end 28 deepest in the well, furthest from the earth's surface. The proximal end 26 is drivingly connectable or attachable with the rotary drilling string 25 such that rotation of the drilling string 25 from the surface results in a corresponding rotation of the drilling shaft 24. The proximal end 26 of the drilling shaft 24 may be permanently or removably attached, connected or otherwise affixed with the drilling string 25 in any manner and by any structure, mechanism, device, or method permitting the rotation of the drilling shaft 24 upon the rotation of the drilling string 25. In this regard, a drive connection connects the drilling shaft 24 with the drilling string 25. As indicated, the drive connection may be comprised of any structure, mechanism or device for drivingly connecting the drilling shaft 24 and the drilling string 25 so that rotation of the drilling string 25 results in a corresponding rotation of the drilling shaft 24.

The distal end 28 of the drilling shaft 24 is drivingly connectable or attachable with the rotary drill bit 22 such that rotation of the drilling shaft 24 by the drilling string 25 results in a corresponding rotation of the drill bit 22. The distal end 28 of the drilling shaft 24 can be permanently or removably coupled with the drill bit 22 in any manner and by any structure, mechanism, device, or method permitting the rotation of the drill bit 22 upon the rotation of the drilling shaft 24. In the exemplary embodiment, a threaded connection can be utilized.

The drilling shaft 24 may be comprised of one or more elements or portions connected, attached, or otherwise affixed together in any suitable manner providing a unitary drilling shaft 24 between the proximal and distal ends (26, 28). In some examples, any connections provided between the elements or portions of the drilling shaft 24 are relatively rigid such that the drilling shaft 24 does not include any flexible joints or articulations therein. Additionally, the drilling shaft 24 can be composed of a single, unitary or integral element extending between the proximal and distal ends (26, 28). Further, the drilling shaft 24 may be tubular or hollow to permit drilling fluid (mud) to flow therethrough in a relatively unrestricted and unimpeded manner.

The drilling shaft 24 can be comprised of any material suitable for and compatible with rotary drilling. For example, the drilling shaft 24 can be comprised of high strength stainless steel. Drill shaft 24 is sometimes referred to as a mandrel.

The rotary steerable drilling device 20 comprises a housing 46 for rotatably supporting a length of the drilling shaft 24 for rotation therein upon rotation of the attached drilling string 25. The housing 46 may support, and extend along any length of, the drilling shaft 24. However, in the illustrated example, the housing 46 supports substantially the entire length of the drilling shaft 24 and extends substantially between the proximal and distal ends (26, 28) of the drilling shaft 24. The drilling shaft 24 and the housing 46 may each be substantially cylindrical shaped and share a longitudinal centerline 91.

The housing 46 may be comprised of one or more tubular or hollow elements, sections, or components permanently or removably connected, attached, or otherwise affixed together to provide a unitary or integral housing 46 permitting the drilling shaft 24 to extend therethrough.

The rotary steerable drilling device 20 can optionally be further comprised of a near bit stabilizer 89 located adjacent to the distal end of the housing 46. The near bit stabilizer 89 can be comprised of any type of stabilizer and may be either adjustable or non-adjustable.

The distal end comprises a distal radial bearing which comprises a fulcrum bearing, also referred to as a focal bearing, or some other bearing which facilitates the pivoting of the drilling shaft 24 at the distal radial bearing location upon the controlled deflection of the drilling shaft 24 by the rotary steerable drilling device 20 to produce a bending or curvature of the drilling shaft 24.

The rotary steerable drilling device 20 can further comprise at least one proximal radial bearing which can be contained within the housing 46 for rotatably supporting the drilling shaft 24 radially at a proximal radial bearing location defined thereby.

The deflection assembly within the rotary steerable drilling device 20 provides for the controlled deflection of the drilling shaft 24 resulting in a bend or curvature of the drilling shaft 24, as described further below, in order to provide the desired deflection of the attached drill bit 22. The orientation of the deflection of the drilling shaft 24 can be altered in order to change the orientation of the drill bit 22 or toolface, while the magnitude of the deflection of the drilling shaft 24 can also be altered to vary the magnitude of the deflection of the drill bit 22 or the bit tilt relative to the housing 46.

The rotary steerable drilling device 20 comprises a distal seal or sealing assembly and a proximal seal or sealing assembly 282. The distal seal can be radially positioned and provide a rotary seal between the housing 46 and the drilling shaft 24 at, adjacent or in proximity to the distal end of the housing 46. In this way, the housing 46 can be maintained as a compartment or container for the contents located therein. Additionally, the compartment can be a closed compartment when it is sealed.

The rotary steerable drilling device 20 can include one or more thrust bearings at thrust bearing locations. Thrust bearings can be positioned at any location along the length of the drilling shaft 24 that rotatably and radially supports the drilling shaft 24 within the housing 46, but resists longitudinal movement of the drilling shaft 24 relative to the housing 46.

As noted above with respect to FIG. 1, the rotary steerable drilling device 20 can have a sensor sub-unit 52. The sensor sub-unit may have a housing orientation sensor apparatus for sensing the orientation of the housing 46 within the wellbore. For instance, the housing orientation sensor apparatus can contain an At-Bit-Inclination (ABI) insert associated with the housing 46. Additionally, the rotary steerable drilling device 20 can have a drilling string orientation sensor apparatus 376. Sensors which can be employed to determine orientation include, for example, magnetometers and accelerometers.

The rotary steerable drilling device 20 may include a releasable drilling-shaft-to-housing locking mechanism to selectively lock the drilling shaft 24 and housing 46 together. In some situations downhole, it is desirable that the shaft 24 not rotate relative to the housing 46. For example, if the drilling device 20 gets stuck downhole it may be desirable to rotate the housing 46 with the drill string to dislodge the drilling device 20 from the wellbore. In order to do that, the locking mechanism may be engaged (locked) to prevent the drilling shaft 24 from rotating in the housing 46. Once locked, turning the drill string turns the housing 46. Further details regarding the locking mechanism are described below.

The rotary steerable drilling device 20 may include a drilling string communication system in order to communicate data or signals along the drilling string 25 from or to downhole locations, as earlier described.

The example of a rotary steerable drilling device 20 is depicted with respect to FIG. 2; however, this disclosure is not limited only to rotary steerable drilling devices. The teachings may be employed with respect to other drilling devices, including mud motors such as the disclosed mud motor 76.

Referring to FIG. 2 and as explained above, during drilling, the rotary steerable drilling device 20 can be anchored in the wellbore against rotation which would otherwise be imparted by the rotating drilling shaft 24. To affect such anchoring, one or more anti-rotation devices 252 can be associated with the rotary steerable drilling device 20 for resisting rotation within the wellbore. Any type of anti-rotation device 252 or any mechanism, structure, device, or method capable of restraining or inhibiting the tendency of the housing 46 to rotate upon rotary drilling can be used.

The anti-rotation device 252 can be associated with any portion of the housing 46 including proximal, central, and distal housing sections. In other words, the anti-rotation device 252 can be located at any location or position along the length of the housing 46 between its proximal and distal ends. In the illustrated embodiment, the anti-rotation device 252 can be associated with a proximal section of the housing 46 toward the ground's surface. Finally, the anti-rotation device 252 can be associated with the housing 46 in any manner permitting the anti-rotation device 252 to inhibit or restrain rotation of the housing 46. The anti-rotation device 252 can be positioned at an exterior surface of the housing 46.

In some examples, the anti-rotation device 252 may include one or more radially deployable drag members, extendible with respect to the longitudinal centerline 91 of the housing 46. As shown in FIG. 2, the drag members may include wheels or rollers and resemble round "pizza cutters" that extend at least partially outside the rotary steerable drilling device 20 and project into the formation surrounding the borehole when deployed. The drag members can be aligned for rotation down the wellbore, allowing the rotary steerable drilling device 20 to progress downhole during drilling. Each drag member can be oriented such that it is capable of rotating about its axis of rotation in response to a force exerted tangentially on the drag member substantially in a direction parallel to the longitudinal axis 91 of the housing 46. For instance, as a longitudinal force is exerted through the drilling string 25 from the surface to the drilling shaft 24 in order to progress drilling, the drag member rolls about its axis to facilitate the rotary steerable drilling device's 20 moving through the wellbore in either a downhole or uphole direction.

The drag members may contact the wall of the wellbore to slow or inhibit the turning of the housing 46 with respect to the drilling shaft 24 while drilling. The drilling shaft 24 within the housing 46 may rotate in the clockwise direction, thus imposing a tendency in housing 46 to also rotate. Accordingly, drag members can have any shape or configuration permitting them to roll or move longitudinally through the wellbore, while also restraining the rotation of the housing 46 within the wellbore. Therefore, each roller has a peripheral surface about its circumference permitting it to roll or move longitudinally within the wellbore and resist rotation.

Figure 3:
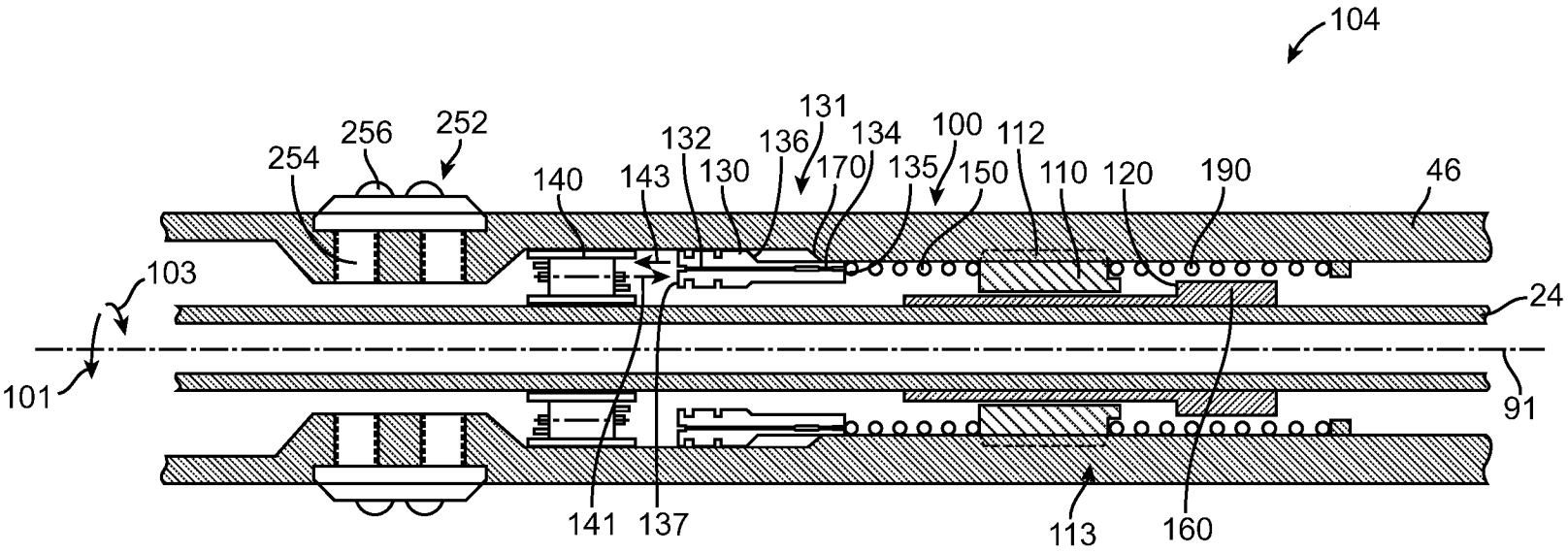
FIG. 3 is a schematic, transverse cross-section view of a releasable locking mechanism for rotationally fixing a drilling shaft to a housing but that is in an unactuated configuration according to the present disclosure.

As illustrated in FIG. 3, the rotary steerable drilling device 20 may include a releasable locking mechanism 100 for selectively engaging the housing 46 with the drilling shaft 24. When engaged, the drilling shaft 24 and the housing 46 may rotate together. The releasable locking mechanism 100 may be used in circumstances where the housing 46 has become stuck in a wellbore, since the application of torque to the housing 46 via the drilling string and the drilling shaft 24 can be sufficient to dislodge the housing 46.

Figure 4:
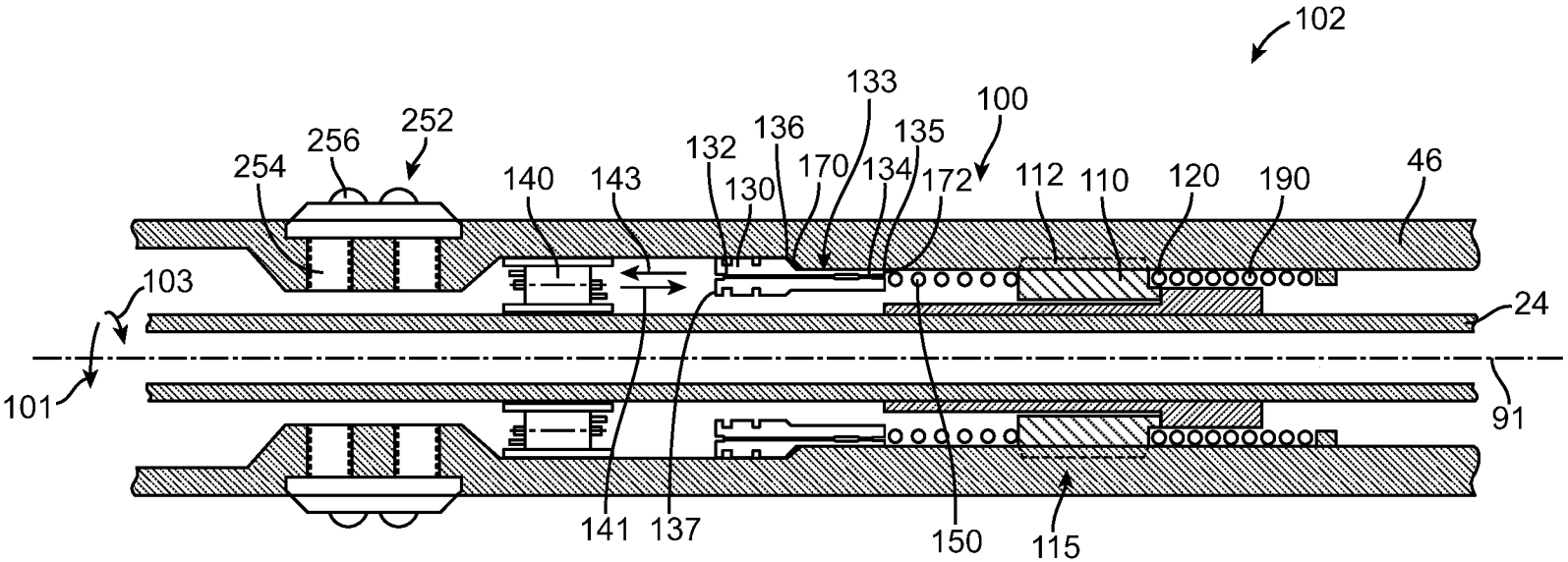
FIG. 4 is a schematic, transverse cross-section view of a releasable locking mechanism for rotationally fixing a drilling shaft to a housing in an actuated configuration according to the present disclosure.

FIG. 3 is a schematic, transverse cross-section view of a releasable locking mechanism 100 for rotationally fixing a drilling shaft 24 to a housing 46. FIG. 3 illustrates the releasable locking mechanism 100 in an unactuated configuration 131 according to the present disclosure. FIG. 4 is a schematic, transverse cross-section view of a releasable locking mechanism 100 for rotationally fixing a drilling shaft 24 to a housing 46 in an actuated configuration 133 according to the present disclosure. The following description is described in relation to FIG. 3 and FIG. 4, wherein the configuration of the features of the releasable locking mechanism 100 is shown in both the unactuated configuration 131 (FIG. 3) and actuated configuration 133 (FIG. 4).

As described herein the releasable locking mechanism 100 can be included in a downhole rotary steerable drill 20. While the releasable locking mechanism 100 is described in relation to a downhole rotary steerable drill 20, the releasable locking mechanism 100 can also be implemented in drilling systems having a mud motor 76 or any other appropriate system. The releasable locking mechanism 100 as described herein can be implemented in situations where a housing and a shaft are generally configured to rotate relative to one another and it is desirable to couple the housing with the shaft so that they rotate together. For example, the disclosure can allow for the housing 46 having the anti-rotation device 252 to be rotatably coupled to the rotating drilling shaft 24. When the housing 46 is rotatably coupled to the rotating drilling shaft 24, a stuck housing and/or anti-rotation device 252 can be released from the stuck position.

As described, the downhole rotary steerable drill 20 comprises a drilling shaft 24 rotatably supported within a housing 46. The drilling shaft 24 and housing 46 can have a common longitudinal axis 91. The downhole rotary steerable drill 20 includes a releasable locking mechanism 100. The releasable locking mechanism 100 rotationally locks and releases the drilling shaft 24 relative to the housing 46. Additionally, the releasable locking mechanism 100 may have a locked configuration 102 and a released configuration 104.

The releasable locking mechanism 100 can include a sliding plunger 110. The sliding plunger 110 is coupled to the housing 46 by a coupling 112 that permits longitudinal reciprocation of the sliding plunger 110 relative to the housing 46. The coupling 112 also prevents rotation of the sliding plunger 110 relative to the housing 46. In the embodiment illustrated in FIG. 3, the coupling 112 may include one or more splines. As illustrated, the one or more splines can be formed on the sliding plunger 110. Alternatively, the splines may be disposed on the housing 46 and receiving grooves can be formed in the sliding plunger 110. In other examples, the coupling 112 can be a keyway. The present disclosure can be implemented with other types of couplings that permit the sliding plunger 110 to move in the longitudinal direction substantially parallel to the longitudinal axis 91 and provide for a transfer of rotational force to the housing 46.

The sliding plunger 110 can also be configured to engage a ratchet mechanism 120 that prevents rotation of the drilling shaft 24 relative to the housing 46 in a drilling rotational direction 101. The ratchet mechanism 120 can also permit rotation of the drilling shaft 24 relative to the housing 46 in a direction 103 opposite to the drilling rotational direction 101 in the locked configuration (illustrated in FIG. 4) of the locking mechanism 100. While the term ratchet mechanism 120 is used herein, other types of mechanism that allow for rotational slippage in one direction and engagement in an opposite direction are within the scope of this disclosure.

The releasable locking mechanism 100 may include a pressure-responsive piston 130. The pressure-responsive piston 130 can be configured to reciprocate between an unactuated configuration 131 and actuated configuration (as shown in FIG. 4). The reciprocation between the unactuated configuration 131 and the actuated configuration can be in response to applied pressure from a pressuring pump 140. The actuated configuration of the pressure-responsive piston 130 can correspond to the locked configuration 102 of the locking mechanism 100. In the locked configuration 102 of the locking mechanism 100 the plunger 110 can engage with the ratchet mechanism 120. The pressure-responsive piston 130 can have one or more seals configured about it. The seals provide for a seal so that pressure applied from the pressuring pump 140 acts on a surface of the pressure-responsive piston 130.

The pressure-responsive piston 130 can be configured to allow for repeated actuation of the releasable locking mechanism 100. Additionally, the pressure-responsive piston 130 may include a pressure equalization valve 132. The pressure equalization valve 132 provides pressure relief and returns the pressure-responsive piston 130 to the unactuated configuration 131 from an actuated configuration 133.

The pressure-responsive piston 130 can further comprise a flow restrictor 134. The flow restrictor 134 can be formed by having a constriction in a tube or other passageway connecting the end 135 nearest to the sliding plunger 110 to an opposite end 137. The flow restrictor can be a plate restrictor, a valve, or other structure that restricts flow. Further, the flow restrictor 134 can be configured for a particular application. Additionally, the flow restrictor 134 can be varied. The flow restrictor 134 can be configured to restrict flow of fluid entering the pressure-responsive piston 130 from an end 135 nearest to the sliding plunger 110. The fluid can exit the pressure-responsive piston 130 at an opposite end 137. The opposite end 137 can be the portion of the pressure-responsive piston 130 that is closest to the pressuring pump 140.

The releasable locking mechanism 100 further comprises a piston stop 170 formed on the inside of the housing 46. The piston stop 170 prevents axial movement of the pressure-responsive piston 130 beyond a predetermined position 172 in the actuated configuration. The piston stop 170 may include a beveled shoulder and the pressure-responsive piston 130 can have a mating portion 136 that is configured to engage the beveled shoulder. While a beveled shoulder is illustrated, the piston stop 170 can be include other surfaces such as straight surface, a curved surface, or other sloped surface. The piston stop 170 can also be a pin or other protruding member configured to engage with a portion of the pressure-responsive piston 130. The pressure-responsive piston 130 can have a portion that is configured to engage with the corresponding piston stop 170.

The pressuring pump 140 can be configured to drive flow in an actuating direction 141 and a releasing direction 143 that is opposite to the actuating direction 141. The pressuring pump 140 can be coupled to the drilling shaft 24. The pressuring pump 140 can be configured to provide pressure to the pressure-responsive piston 130 when the drilling shaft 24 is rotated in the direction 103 opposite to the drilling rotational direction 101. The pressuring pump 140 can be further configured to relieve pressure from the pressure-responsive piston 130 when the drilling shaft 24 is rotated in the drilling rotational direction 101. The pressuring pump 140 can be further configured to not apply any pressure when the housing 46 is coupled to the drilling shaft 24 by the releasable locking mechanism 100.

The releasable locking mechanism 100 includes an engagement biasing member 150 coupling the sliding plunger 110 to the pressure-responsive piston 130. The engagement biasing member 150 provides an engagement force and can allow the sliding plunger 110 to disengage the ratchet mechanism 120 when the drilling shaft 46 is rotated in the direction 103 opposite to the drilling rotational direction 101. Additionally, the engagement biasing 150 member can be a spring member.

The releasable locking mechanism 100 can include a disengagement biasing member 190 configured to urge the sliding plunger 110 to a released configuration 113. In the illustrated example, the disengagement biasing member 190 includes a spring member. The disengagement biasing member 190 can be configured to provide a predetermined amount of force to the sliding plunger 110 to urge the sliding plunger 110 away from the drilling shaft engagement member 160. The urging force can in turn cause the pressure-responsive piston 130 to move upward as well.

Figure 5:
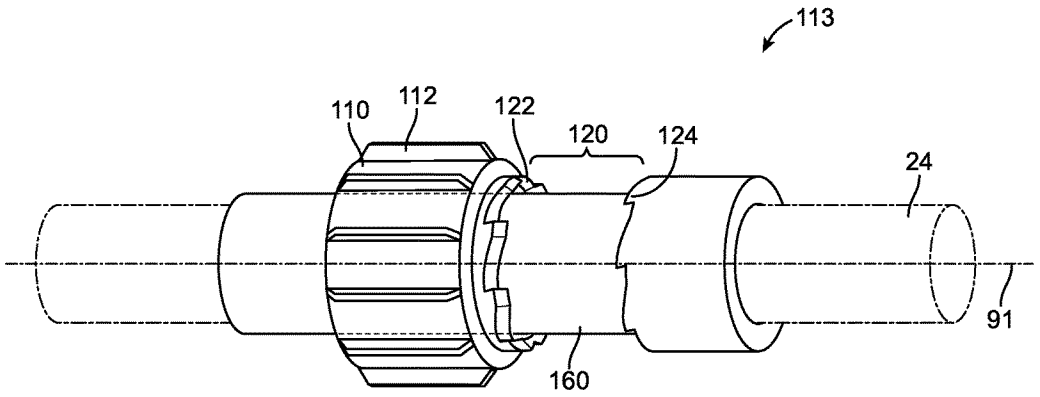
FIG. 5 is a partial perspective view of a releasable locking mechanism in a released configuration according to the present disclosure.
Figure 6:
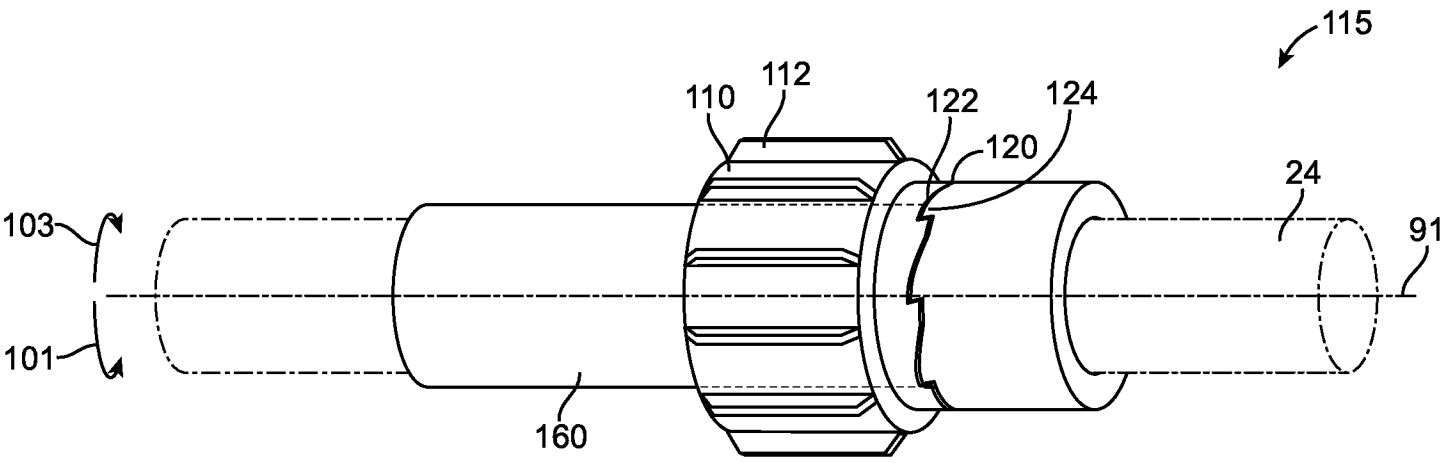
FIG. 6 is a partial perspective view of a releasable locking mechanism in an engaged configuration according to the present disclosure.
Figure 7:
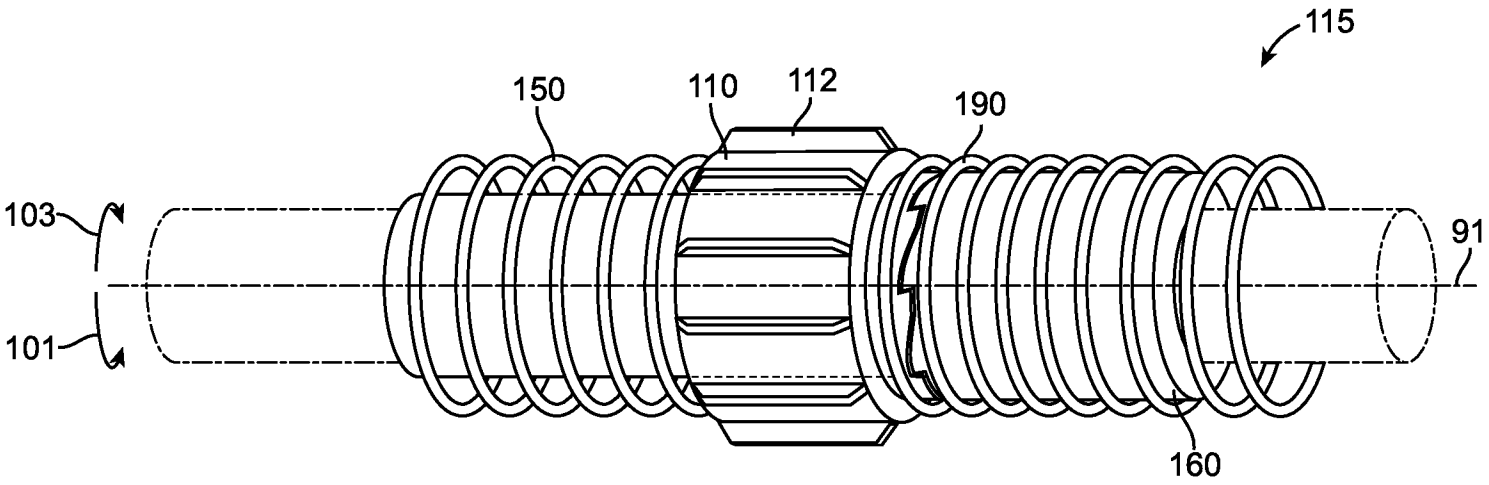
FIG. 7 is a partial perspective view of a releasable locking mechanism including an engagement biasing member and a disengagement biasing member in an engaged configuration according to the present disclosure.

FIGS. 5-7 are presented to further illustrate the ratchet mechanism 120 described above. FIG. 5 illustrates a partial perspective view of a releasable locking mechanism in a released configuration 113 according to the present disclosure. FIG. 6 illustrates a partial perspective view of a releasable locking mechanism in an engaged configuration 115 according to the present disclosure. FIG. 7 is a partial perspective view of a releasable locking mechanism including an engagement biasing member 150 and a disengagement biasing member 190 in an engaged configuration 115 according to the present disclosure.

FIG. 6 illustrates only a few of the components of the releasable locking mechanism in order to specifically illustrate the ratchet mechanism 120. The components of the releasable locking mechanism that are illustrated include the sliding plunger 110 and drilling shaft engagement member 160. As illustrated, the sliding plunger 110 can include one or more couplings 112, exemplarily in the form of splines. The couplings 112, for example splines as illustrated, of the sliding plunger 110 can be configured to engage with one or more receiving portions formed on the housing (not illustrated). The drilling shaft engagement member 160 can be coupled to the drilling shaft 24. The drilling shaft engagement member 160 can be configured to move in an axial direction relative to the drilling shaft 24 and remain in a fixed rotational position relative to the drilling shaft 24. For example, the drilling shaft engagement member 160 can be coupled to the drilling shaft 24 by one or more splines.

The ratchet mechanism 120 can be formed from an engaging portion of the sliding plunger 110 and drilling shaft engagement member. Thus, the ratchet mechanism 120 can be partially located on the sliding plunger 110 and partially located on the drilling shaft engagement member. As illustrated, the ratchet mechanism 120 comprises two substantially sawtooth profiles (122, 124) configured to lock together in the rotational drilling direction 101 and slip relative to one another in the rotational direction 103 opposite the rotational drilling direction 101.

One of the two substantially sawtooth profiles 122 can be on the sliding plunger 110 and the other 124 of the two substantially sawtooth profiles (122, 124) can on a drilling shaft engagement member 160 that is rotationally fixed to the drilling shaft 24. As illustrated, the rotational drilling direction 101 and rotational direction 103 opposite the rotational drilling direction 101 are illustrated as being about the longitudinal centerline 91 of the drilling shaft 24. The sliding plunger 110 and the drilling shaft engagement member 160 can be configured to have the same longitudinal centerline 91 as the drilling shaft.

The sawtooth profile 122 on the sliding plunger 110 can be such that it has a positive and a negative rake from the peak. The positive rake allows the sawtooth profile 122 to be positively engaged with a positive rake portion of the sawtooth profile 124 on the drilling shaft engagement member 160.

As illustrated in FIG. 6, when the two positive rake portions engage with one another, the sliding plunger 110 can be coupled together with the drilling shaft engagement member 160, thereby allowing the housing to rotate together with the drilling shaft 24. The sliding plunger 110 communicates the rotational motion to the housing (not shown) via a coupling 112 which is in the form of a spline.

As illustrated in FIG. 7, the releasable locking mechanism can include an engagement biasing member 150 and a disengagement biasing member 190. In order to accommodate the slip of the sliding plunger 110 relative to the drilling shaft engagement member 160 in the rotation direction 103 opposite the drilling rotation direction 101, the engagement biasing member 150 allows the sliding plunger 110 to reciprocate upwards as the two negative rakes of the sawtooth profiles (122, 124) slide relative to each other.

Figure 8:
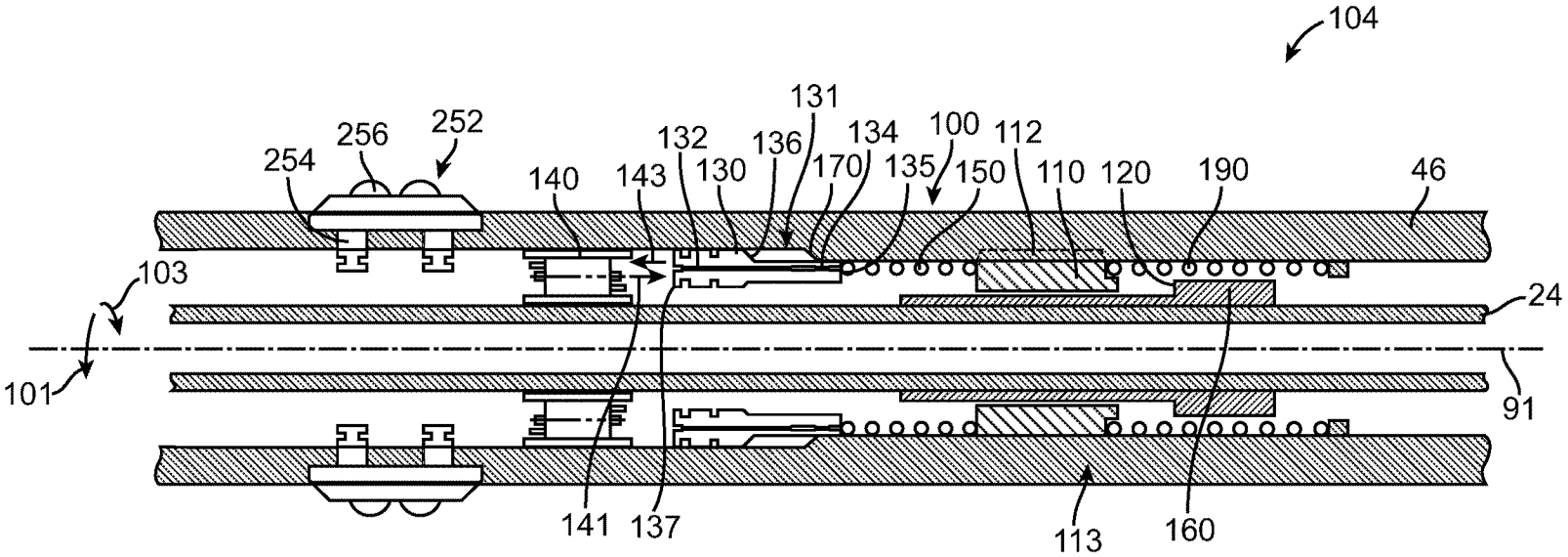
FIG. 8 is a schematic, transverse cross-section view of another releasable locking mechanism in an unactuated configuration in accordance with the present disclosure.
Figure 9:
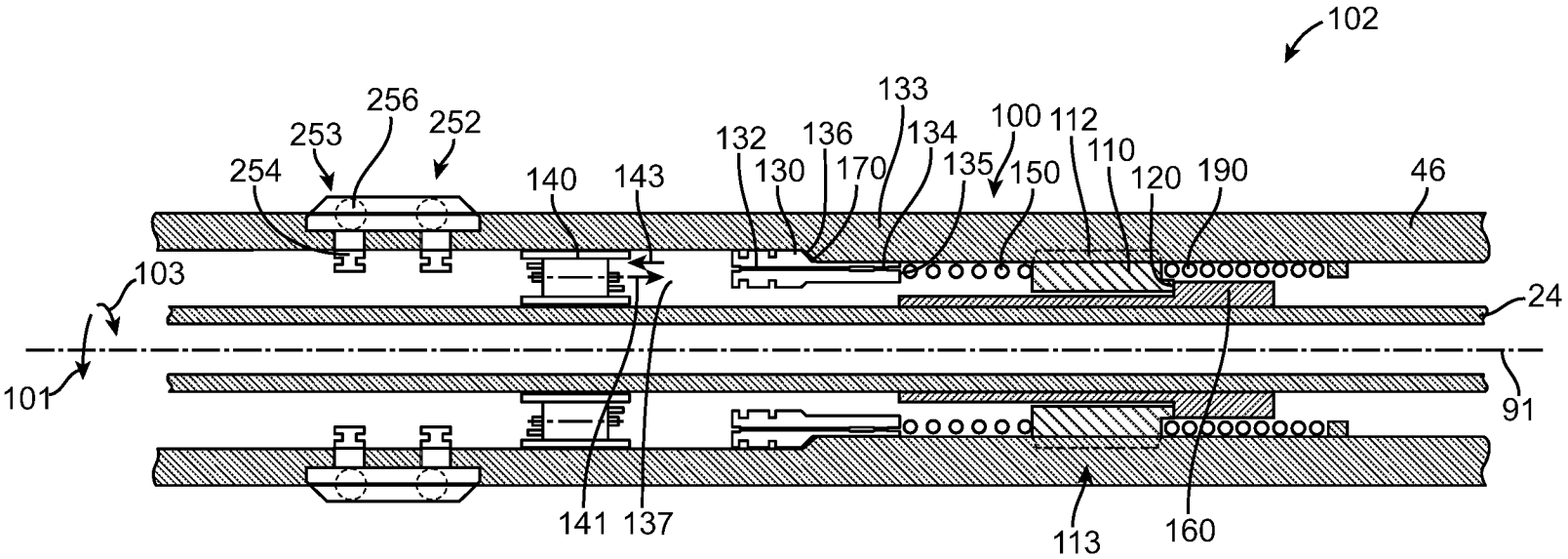
FIG. 9 is a schematic, transverse cross-section view of another releasable locking mechanism in an actuated configuration in accordance with the present disclosure.

FIGS. 8 and 9 are provided to illustrate an alternative embodiment of the example as provided in FIGS. 3 and 4. FIG. 8 illustrates a schematic, transverse cross-section view of another releasable locking mechanism 100 in an unactuated configuration 131 in accordance with the present disclosure. FIG. 9 illustrates a schematic, transverse cross-section view of another releasable locking mechanism 131 in an actuated configuration 133 in accordance with the present disclosure.

As illustrated in FIGS. 3, 4, 8, and 9, the downhole rotary steerable drill 20 can include an anti-rotation device 252 that can be configured to substantially limit rotation of the housing 46 relative to a formation in which the downhole rotary steerable drill 20 is deployed. The anti-rotation device 252 can include one or more of the components as described above in the anti-rotation device section. The anti-rotation device 252 as illustrated in FIGS. 3 and 4 can be configured to be operated by one or more spring based 254 biasing members 256. When one or more spring based 254 biasing members 256 are implemented, the anti-rotation device 252 can be configured to bias drag members away from the housing 46.

In FIGS. 8 and 9, the spring based 254 biasing members 256 are replaced by hydraulically based 254 biasing members 256. As illustrated, the anti-rotation device 252 can be fluidly coupled to the pressuring pump 140. The anti-rotation device 252 can be configured to be retracted when the pressuring pump 140 provides pressure to the pressure-responsive piston 130. For example, the drag members of the anti-rotation device can be retracted (see FIG. 9). Further, as illustrated, the anti-rotation device 252 can be configured to be in a retracted configuration 253 when the releasable locking mechanism 100 is in a locked configuration 102.

While some of the examples described herein make use of a rotary steerable drilling device 20, the present disclosure is not so limited. For example, the locking mechanism 100 can be implemented in a drilling system employing a mud motor 76. For example where the housing associated with the mud motor becomes stuck, the locking mechanism 100 can be employed to selectively lock the housing with the drilling shaft so that the drilling shaft and the housing rotate together.

The presently disclosed drilling system can be alternatively described, particularly with respect to FIGS. 3 and 4, as comprising a drilling shaft 24 rotatably supported in a housing 46 and rotating in a drilling direction relative the housing 46 during active drilling. A one-way clutch 100 that is reverse-rotation actuated is coupled between the housing 46 and the drilling shaft 24. The clutch 100 secures the drilling shaft 24 to the housing 46 as a result of rotation of the drilling shaft 24 in the direction opposite to the drilling direction. The one-way clutch 100 comprises two mutually engageable ratchet surfaces 120 that are generally opposite one another and that when engaged, retard relative motion when the drilling shaft 24 rotates in the drilling direction. Alternatively, the one-way clutch 100 facilitates relative motion between the drilling shaft 24 and housing 46 when the drilling shaft 24 is rotated in the direction opposite to the drilling direction. A splined coupling 112 that permits translational motion and prevents rotational motion connects one of the two ratchet surfaces 120 (see also FIGS. 5-7, sawtooth profiles 122, 124) to one of the drilling shaft 24 or the housing 46. A pressure activated actuator 131 moves the spline-coupled ratchet surface 120, 122 toward and into engagement with the other ratchet surface 120, 124 when the drilling shaft 24 is rotated in the direction opposite to the drilling direction. In this way, the one-way clutch 100 is transitioned from a released configuration 104 to a locked configuration 102 in which rotation of the drilling shaft in the drilling direction rotates the housing in the drilling direction.

The pressure activated actuator 131 further comprises a sliding plunger 110 on which the spline-coupled ratchet surface 120 is located and the sliding plunger 110 is keyed to the housing 46 by the splined coupling 112. A pump 140 is included that is in fluid communication with a piston 130 that reciprocates between an unactuated configuration and an actuated configuration in response to delivered pressure from the pump 140. The actuated configuration of the piston 130 corresponds to the locked configuration of the one-way clutch 100. In the actuated configuration, the piston 130 is engaged with the sliding plunger 110 and the ratchet surfaces 120 abut one another.

Figure 10:
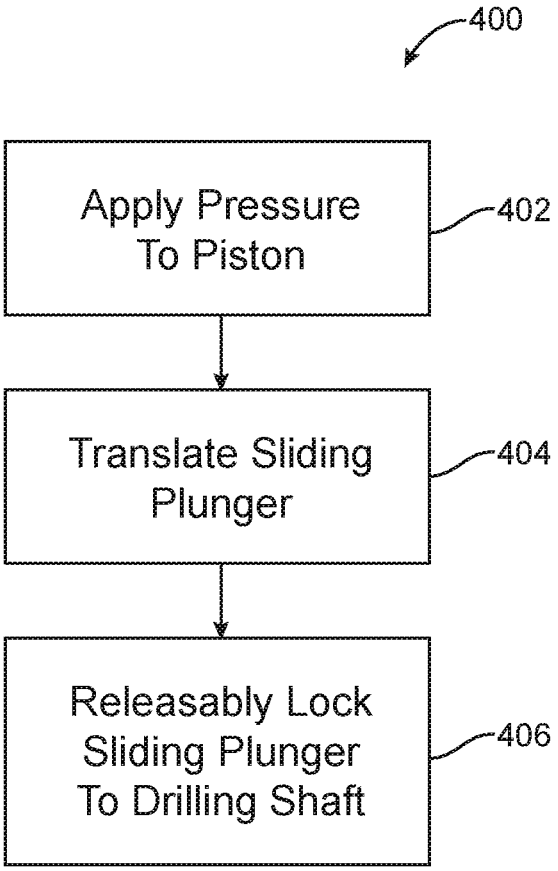
FIG. 10 is a flowchart of an example method according to the present disclosure.

FIG. 10 is a flowchart of an example method 400 according to the present disclosure. The method 400 can implement one or more of the above described components along with the associated actuation and deactivation thereof. For example, the method 400 can be implemented by a controller. The controller can be configured to control the motion of the components. In other implementations, no controller can be implemented and the components can be responsive to the direction of rotation of the drilling shaft, which can in turn cause one or more of the components to function, for example activation of a pressuring pump. In other implementations, other controls of the pressure-responsive piston are considered within the scope of this disclosure.

The method 400 can comprise applying pressure to a pressure-responsive piston (block 402). The pressure to the pressure-responsive piston can be applied from a pressuring pump. The pressuring pump and the pressure-responsive piston can be configured as described above.

The method 400 can further comprise translating a sliding plunger coupled to the pressure-responsive piston (block 404). The sliding plunger can translate in response to force being transferred by the pressure-responsive piston. Additionally, an engagement biasing member can be coupled to the pressure-responsive piston and transfer force to the sliding plunger. Additionally, the engagement biasing member can allow the pressure-responsive piston to reciprocate away from a ratchet mechanism that is configured to couple the sliding plunger to a drilling shaft engagement member.

The present method 400 can also include releasably locking the sliding plunger to the drilling shaft. The releasable locking of the sliding plunger to the drilling shaft can be through a ratchet mechanism. The ratchet mechanism can be configured to prevent rotation of the drilling shaft relative to the housing in a drilling rotational direction. The ratchet mechanism can further be configured to permit rotation of the drilling shaft relative to the housing in a direction opposite to the drilling rotational direction in the locked configuration of the locking mechanism.

Additionally, the method can include disengagement of the locking mechanism. The locking mechanism can be disengaged in response to rotational motion of the drilling shaft being suspended for more than a predetermined period of time. For example, if the drilling shaft is held substantially in a non-rotational state, a disengagement biasing member can urge the sliding plunger away from the drilling shaft engagement member so that the drilling shaft and housing can be decoupled from each other. When the drilling shaft and the housing are decoupled from one another, the drilling shaft can rotate independently from the housing. As described above, the housing can be configured to be maintained in a substantially fixed rotation orientation. The housing, even in the substantially fixed rotation orientation, can rotate, but the rotational speed of the housing is substantially less than the rotational speed of the drilling shaft.

The pressure-responsive piston can include a pressure-relief valve that is configured to allow fluid to flow through the pressure-relief valve once the locking mechanism is disengaged and thereby the pressure-responsive piston can return to an unactuated configuration.

Numerous examples are provided herein to enhance understanding of the present disclosure. A specific set of examples are provided as follows. In a first example, a drilling system is disclosed including a drilling shaft rotatably supported in a housing, the drilling shaft rotating in a drilling direction relative the housing during active drilling; a reverse-rotation actuated one-way clutch coupled between the housing and the drilling shaft that secures the drilling shaft to the housing as a result of rotation of the drilling shaft in the direction opposite to the drilling direction, the one-way clutch including: two mutually engageable ratchet surfaces that when engaged retard relative motion therebetween when the drilling shaft rotates in the drilling direction and facilitate relative motion therebetween when the drilling shaft is oppositely rotated to the drilling direction; a splined coupling that permits translational motion and prevents rotational motion interconnects one of the two ratchet surfaces to one of the drilling shaft and the housing; and a pressure activated actuator that moves the spline-coupled ratchet surface toward and into engagement with the other ratchet surface when the drilling shaft is rotated in the direction opposite to the drilling direction, thereby transitioning the one-way clutch from a released configuration to a locked configuration in which rotation of the drilling shaft in the drilling direction rotates the housing in the drilling direction.

In a second example, a drilling system is disclosed according to the first example, wherein the pressure activated actuator further includes a sliding plunger on which the spline-coupled ratchet surface is located, wherein the sliding plunger is keyed to the housing by the splined coupling; and a pump in fluid communication with a piston that reciprocates between an unactuated configuration and an actuated configuration in response to delivered pressure from the pump, wherein the actuated configuration of the piston corresponds to the locked configuration of the one-way clutch and the piston is engaged with the sliding plunger and the ratchet surfaces abut one another.

In a third example, a drilling system is disclosed according to the first or second examples, wherein the piston further includes a pressure equalization valve configured to provide pressure relief and permit return the piston to the unactuated configuration.

In a fourth example, a drilling system is disclosed according to any of the preceding examples first to the third, wherein the piston further includes a flow restrictor configured to restrict fluid flow through the piston.

In a fifth example, a drilling system is disclosed according to any of the preceding examples first to the fourth, further including an engagement biasing member positioned between the sliding plunger and the piston, wherein the engagement biasing member provides a biasing force that urges the sliding plunger into an engaged configuration in which the two ratchet surfaces are engaged.

In a sixth example, a drilling system is disclosed according to any of the preceding examples first to the fifth, wherein the engagement biasing member includes a coil spring.

In a seventh example, a drilling system is disclosed according to any of the preceding examples first to the sixth, further including a disengagement biasing member configured to urge the sliding plunger to a released configuration in which the two ratchet surfaces are disengaged.

In an eighth example, a drilling system is disclosed according to any of the preceding examples first to the seventh, wherein the pump is configured to drive flow in a piston-actuating direction and a piston-withdrawing direction that is opposite to the piston-actuating direction.

In a ninth example, a drilling system is disclosed according to any of the preceding examples first to the eighth, wherein the pump is coupled to the drilling shaft and provides actuation pressure to the piston when the drilling shaft is rotated in the direction opposite to the drilling direction.

In a tenth example, a drilling system is disclosed according to any of the preceding examples first to the ninth, wherein each of the ratchet surfaces includes a substantially sawtooth profile that are configured to lock together when the drilling shaft rotates in the drilling direction and to slip relative to one another when the drilling shaft rotates in the direction opposite to the drilling direction.

In an eleventh example, a drilling system is disclosed according to any of the preceding examples first to the tenth, wherein one of the two substantially sawtooth profiles is on the sliding plunger and the other of the two substantially sawtooth profiles is on a drilling shaft engagement member that is rotationally fixed to the drilling shaft.

In a twelfth example, a drilling system is disclosed according to any of the preceding examples first to the eleventh, further including a releasable anti-rotation device that is configured to retard rotation of the housing in a wellbore when the anti-rotation device is engaged.

In a thirteenth example, a drilling system is disclosed according to any of the preceding examples first to the twelfth, wherein the anti-rotation device is fluidly coupled to the pump and the anti-rotation device is configured to retract away from the wellbore when the pump drives fluid flow in the piston-actuating direction.

In a fourteenth example, a drilling system is disclosed according to any of the preceding examples first to the thirteenth, wherein the anti-rotation device is configured to be in a retracted configuration when the one-way clutch is in the locked configuration.

In a fifteenth example, a drilling system is disclosed according to any of the preceding examples first to the fourteenth, wherein the anti-rotation device is spring biased toward an engaged configuration with the wellbore.

In a sixteenth example, a drilling system is disclosed according to any of the preceding examples first to the fifteenth, further including a drilling shaft engagement member coupled to the drilling shaft and that is configured to move in an axial direction relative to the drilling shaft while remaining rotationally fixed relative to the drilling shaft.

In a seventeenth example, a drilling system is disclosed according to any of the preceding examples first to the sixteenth, wherein one of the two mutually engageable ratchet surfaces is located on the sliding plunger and the other of the two mutually engageable ratchet surfaces is located on the drilling shaft engagement member.

In an eighteenth example, a drilling system is disclosed according to any of the preceding examples first to the seventeenth, further including a piston stop formed on the inside of the housing that prevents axial movement of the piston beyond a predetermined position in the actuated configuration and wherein the piston stop is a beveled shoulder and the piston has a mating portion that is configured to abuttingly engage the beveled shoulder of the piston stop.

In an nineteenth example, a method of locking a housing of a drilling system to a rotary drilling shaft supported within the housing is disclosed, the method including reverse-rotating, in the direction opposite to the drilling rotational direction, a one-way clutch coupled between the housing and the drilling shaft and thereby securing the drilling shaft to the housing against relative rotation therebetween; and engaging together two mutually engageable ratchet surfaces that when engaged retard relative motion therebetween when the drilling shaft rotates in the drilling direction and that facilitate relative motion therebetween when the drilling shaft is oppositely rotated to the drilling direction.

In a twentieth example, a method is disclosed according to the nineteenth, further including utilizing a pressure activated actuator to move one ratchet surface toward and into engagement with the other ratchet surface when the drilling shaft is rotated in the direction opposite to the drilling direction and thereby transitioning the one-way clutch from a released configuration to a locked configuration in which rotation of the drilling shaft in the drilling direction rotates the housing in the drilling direction.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A drilling system comprising:

a drilling shaft rotatably supported in a housing, the drilling shaft rotating in a drilling direction relative the housing during active drilling;

a reverse-rotation actuated one-way clutch coupled between the housing and the drilling shaft that secures the drilling shaft to the housing as a result of rotation of the drilling shaft in the direction opposite to the drilling direction, the one-way clutch comprising:

two mutually engageable ratchet surfaces that when engaged retard relative motion therebetween when the drilling shaft rotates in the drilling direction and facilitate relative motion therebetween when the drilling shaft is oppositely rotated to the drilling direction;

a splined coupling that permits translational motion and prevents rotational motion connecting one of the two ratchet surfaces to one of the drilling shaft and the housing; and a pressure activated actuator configured to move the spline-coupled ratchet surface, when the drilling shaft is rotated in the direction opposite to the drilling direction, toward and into engagement with the other ratchet surface, thereby transitioning the one-way clutch from a released configuration to a locked configuration in which rotation of the drilling shaft in the drilling direction rotates the housing in the drilling direction.

2. The drilling system of claim 1, wherein the pressure activated actuator further comprises:

a sliding plunger on which the spline-coupled ratchet surface is located, wherein the sliding plunger is keyed to the housing by the splined coupling; and a pump in fluid communication with a piston that reciprocates between an unactuated configuration and an actuated configuration in response to delivered pressure from the pump, wherein the actuated configuration of the piston corresponds to the locked configuration of the one-way clutch and the piston is engaged with the sliding plunger and the ratchet surfaces abut one another.

3. The drilling system of claim 2, wherein the piston further comprises a pressure equalization valve configured to provide pressure relief and permit return the piston to the unactuated configuration.

4. The drilling system of claim 3, wherein the piston further comprises a flow restrictor configured to restrict fluid flow through the piston.

5. The drilling system of claim 2, further comprising:

an engagement biasing member positioned between the sliding plunger and the piston, wherein the engagement biasing member provides a biasing force that urges the sliding plunger into an engaged configuration in which the two ratchet surfaces are engaged.

6. The drilling system of claim 5, wherein the engagement biasing member comprises a coil spring.

7. The drilling system of claim 5, further comprising a disengagement biasing member configured to urge the sliding plunger to a released configuration in which the two ratchet surfaces are disengaged.

8. The drilling system of claim 2, wherein the pump is configured to drive flow in a piston-actuating direction and a piston-withdrawing direction that is opposite to the piston-actuating direction.

9. The drilling system of claim 8, wherein the pump is coupled to the drilling shaft and provides actuation pressure to the piston when the drilling shaft is rotated in the direction opposite to the drilling direction.

10. The drilling system of claim 2, wherein each of the ratchet surfaces comprises a substantially sawtooth profile that are configured to lock together when the drilling shaft rotates in the drilling direction and to slip relative to one another when the drilling shaft rotates in the direction opposite to the drilling direction.

11. The drilling system of claim 10, wherein one of the two substantially sawtooth profiles is on the sliding plunger and the other of the two substantially sawtooth profiles is on a drilling shaft engagement member that is rotationally fixed to the drilling shaft.

12. The drilling system of claim 2, further comprising a releasable anti-rotation device that is configured to retard rotation of the housing in a wellbore when the anti-rotation device is engaged.

13. The drilling system of claim 12, wherein the anti-rotation device is fluidly coupled to the pump and the anti-rotation device is configured to retract away from the wellbore when the pump drives fluid flow in the piston-actuating direction.

14. The drilling system of claim 13, wherein the anti-rotation device is configured to be in a retracted configuration when the one-way clutch is in the locked configuration.

15. The drilling system of claim 14, wherein the anti-rotation device is spring biased toward an engaged configuration with the wellbore.

16. The drilling system of claim 2, further comprising a drilling shaft engagement member coupled to the drilling shaft and that is configured to move in an axial direction relative to the drilling shaft while remaining rotationally fixed relative to the drilling shaft.

17. The drilling system of claim 16, wherein one of the two mutually engageable ratchet surfaces is located on the sliding plunger and the other of the two mutually engageable ratchet surfaces is located on the drilling shaft engagement member.

18. The drilling system of claim 2, further comprising a piston stop formed on the inside of the housing that prevents axial movement of the piston beyond a predetermined position in the actuated configuration and wherein the piston stop is a beveled shoulder and the piston has a mating portion that is configured to abuttingly engage the beveled shoulder of the piston stop.

19. A method of locking a housing of a drilling system to a rotary drilling shaft supported within the housing, the method comprising:

reverse-rotating, in the direction opposite to the drilling rotational direction, the drilling shaft to actuate a one-way clutch coupled between the housing and the drilling shaft and thereby securing the drilling shaft to the housing against relative rotation therebetween;

utilizing a pressure activated actuator to move one ratchet surface, when the drilling shaft is rotated in the direction opposite to the drilling direction, toward and into engagement with the other ratchet surface and thereby transitioning the one-way clutch from a released configuration to a locked configuration in which rotation of the drilling shaft in the drilling direction rotates the housing in the drilling direction; and engaging together two mutually engageable ratchet surfaces that when engaged retard relative motion therebetween when the drilling shaft rotates in the drilling direction and that facilitate relative motion therebetween when the drilling shaft is oppositely rotated to the drilling direction.

* * * * *